US008532540B2

(12) United States Patent
Tanaka

(10) Patent No.: US 8,532,540 B2
(45) Date of Patent: Sep. 10, 2013

(54) IMAGE FORMING APPARATUS AND TONER CONTAINER

(75) Inventor: Hideaki Tanaka, Saitama-shi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 355 days.

(21) Appl. No.: 12/841,752

(22) Filed: Jul. 22, 2010

(65) Prior Publication Data

US 2011/0058855 A1 Mar. 10, 2011

(30) Foreign Application Priority Data

Sep. 8, 2009 (JP) ..... 2009-206690

(51) Int. Cl.
*G03G 15/08* (2006.01)

(52) U.S. Cl.
USPC ..... 399/258

(58) Field of Classification Search
USPC ..... 399/258, 263
See application file for complete search history.

(56) References Cited

U.S. PATENT DOCUMENTS

| | | | | |
|---|---|---|---|---|
| 5,963,766 | A * | 10/1999 | Okuno et al. | 399/256 |
| 2008/0145109 | A1* | 6/2008 | Murayama et al. | 399/260 |
| 2008/0170885 | A1* | 7/2008 | Hatakeyama et al. | 399/254 |
| 2008/0253810 | A1* | 10/2008 | Tateyama et al. | 399/258 |

FOREIGN PATENT DOCUMENTS

| | | | |
|---|---|---|---|
| JP | 10-083111 | A | 3/1998 |
| JP | 2008-175998 | A | 7/2008 |

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

An image forming apparatus includes: a feed portion that is fed with toner from above; a transport path that includes an inlet through which the toner fed to the feed portion enters, that allows the toner to be transported therethrough, and that is in a cylindrical shape; and a transporting member provided to continuously extend from the feed portion to the transport path, the transporting member transporting along the transport path the toner fed to the feed portion, wherein an amount of transportation of the toner per unit of time at a part of the transporting member located in the transport path is larger than an amount of transportation of the toner per unit of time at a part of the transporting member located in the feed portion.

7 Claims, 11 Drawing Sheets

IMAGE FORMING APPARATUS AND TONER CONTAINER

CROSS REFERENCE TO RELATED APPLICATIONS

This application is based on and claims priority under 35 USC §119 from Japanese Patent Application No. 2009-206690 filed Sep. 8, 2009.

BACKGROUND

1. Technical Field

The present invention relates to an image forming apparatus and a toner container.

2. Related Art

Recently, an image forming apparatus, which is capable of preventing toner accumulation or excessive toner feed when the toner is fed to a developing device, has been proposed.

SUMMARY

According to an aspect of the present invention, there is provided an image forming apparatus including: a feed portion that is fed with toner from above; a transport path that includes an inlet through which the toner fed to the feed portion enters, that allows the toner to be transported therethrough, and that is in a cylindrical shape; and a transporting member provided to continuously extend from the feed portion to the transport path, the transporting member transporting along the transport path the toner fed to the feed portion, wherein an amount of transportation of the toner per unit of time at a part of the transporting member located in the transport path is larger than an amount of transportation of the toner per unit of time at a part of the transporting member located in the feed portion.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, a first exemplary embodiment of the present invention is described in detail with reference to the accompanying drawings.

Figure 1:
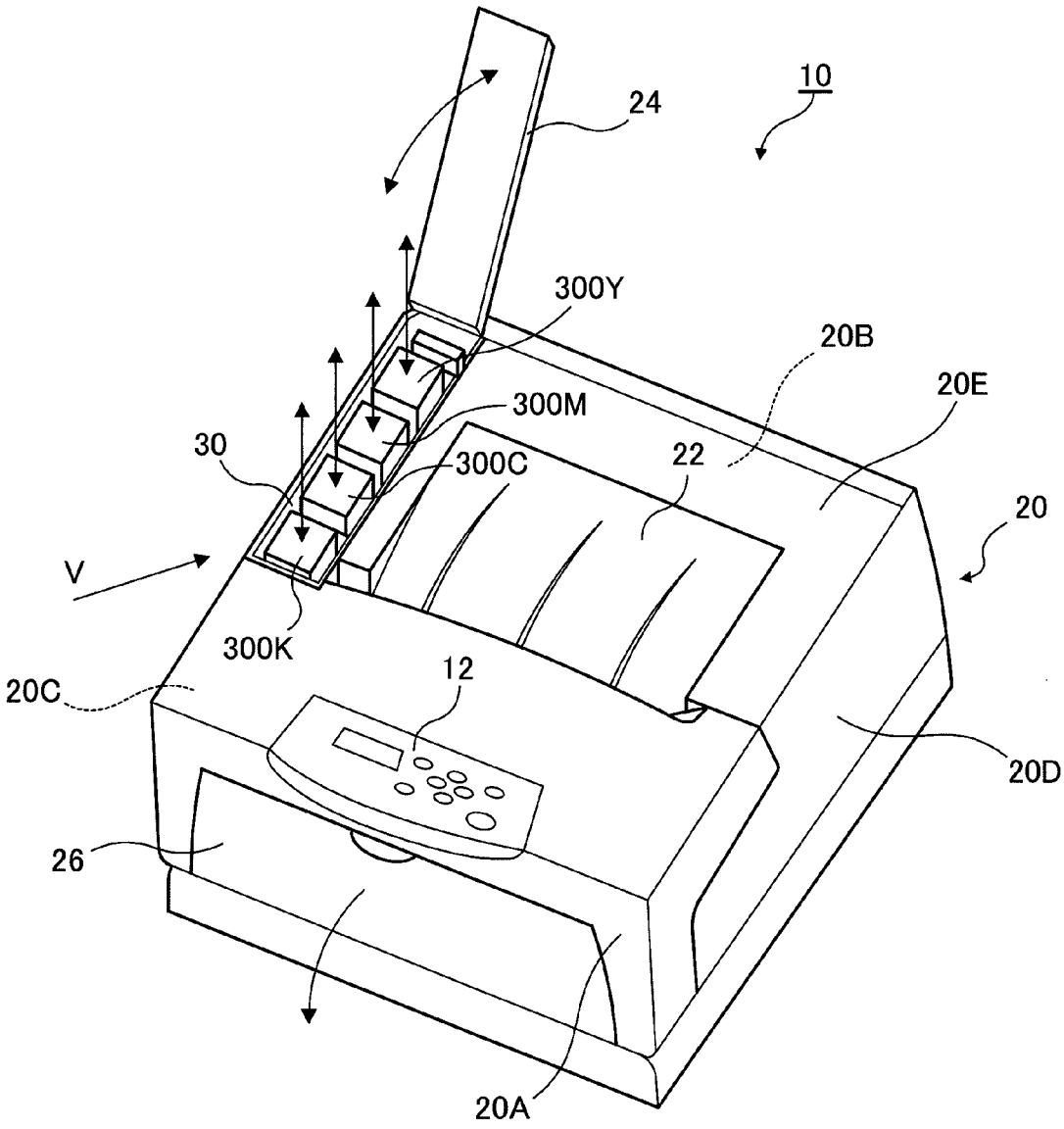
FIG. 1 illustrates an image forming apparatus according to exemplary embodiments of the present invention.

FIG. 1 illustrates an image forming apparatus 10 according to exemplary embodiments of the present invention.

As shown in this figure, the image forming apparatus 10 includes a housing 20. This housing 20 is formed in the shape of a rectangular parallelepiped, and includes a first sidewall 20A on the front side of the image forming apparatus 10, a second sidewall 20B on the rear side, a third sidewall 20C on the left when viewed from the front side, and a fourth sidewall 20D on the right when viewed from the front side. The housing 20 also has, in an upper surface 20E thereof, an exit portion 22 through which a sheet having an image formed thereon is outputted. Further, on the upper surface 20E of the housing 20, an operation panel 12 is provided to accept operations from a user.

Moreover, in the upper surface 20E of the housing 20, an openable attachment portion 24 is provided to be openable and closable. Furthermore, in the first sidewall 20A of the housing 20, an openable sheet feed portion 26 is provided to be openable and closable. The openable attachment portion 24 is opened and closed when containers 300Y, 300M, 300C, and 300K are attached in the image forming apparatus 10 and when the containers 300Y, 300M, 300C, and 300K are detached from the image forming apparatus 10. On the other hand, the openable sheet feed portion 26 is opened when a sheet is fed from the front side of the image forming apparatus 10.

The image forming apparatus 10 has an attachment portion 30 in which the containers 300Y, 300M, 300C, and 300K are attached. The containers 300Y, 300M, 300C, and 300K contain yellow, magenta, cyan, and black toners, respectively. The containers 300Y, 300M, and 300C have the same shape and size to have a capacity of the same volume of toner. The container 300K is formed to be vertically longer than the containers 300Y, 300M, and 300C, and is larger than the containers 300Y, 300M, and 300C. Accordingly, the container 300K has a capacity of a larger volume of toner than the containers 300Y, 300M, and 300C. It should be noted that the containers 300Y, 300M, and 300C and the container 300K have similar configurations and functions, except for toner capacities. It should also be noted that in this specification, any of the containers 300Y, 300M, 300C, and 300K is representatively referred to as a container 300 in some cases below.

Figure 2:
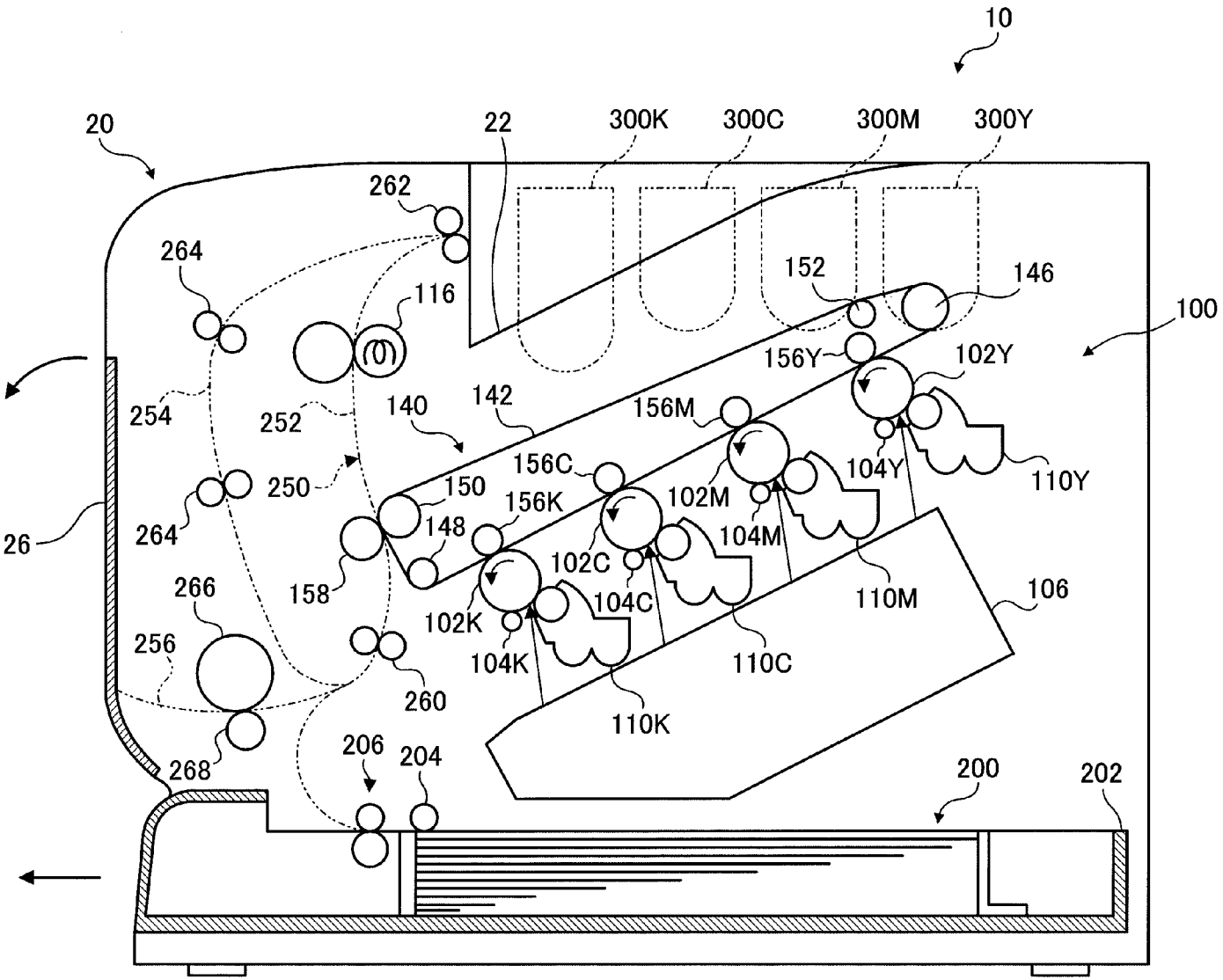
FIG. 2 is a cross-sectional view of the image forming apparatus.

FIG. 2 is a cross-sectional view of the image forming apparatus 10.

As shown in this figure, the image forming apparatus 10 of this exemplary embodiment includes, inside the housing 20, an image forming unit 100 and a sheet feeder 200 for feeding a sheet to the image forming unit 100. Further, the image forming apparatus 10 includes, inside the housing 20, a transport path 250 for use in the transportation of a sheet.

The image forming unit 100 includes: photoconductive drums 102Y, 102M, 102C, and 102K; charging devices 104Y, 104M, 104C, and 104K for charging the photoconductive drums 102Y, 102M, 102C, and 102K; and a latent image forming device 106 that forms an electrostatic latent image by emitting light to the photoconductive drums 102Y, 102M, 102C, and 102K charged by the charging devices 104Y, 104M, 104C, and 104K. The image forming unit 100 further includes developing devices 110Y, 110M, 110C, 110K (hereinafter referred to as developing devices 110 in some cases) that develop, using toners, electrostatic latent images formed on surfaces of the photoconductive drums 102Y, 102M, 102C, and 102K by the latent image forming device 106 and thus form yellow, magenta, cyan, and black toner images. The developing devices 110Y, 110M, 110C, and 110K are fed with yellow, magenta, cyan, and black toners from the containers 300Y, 300M, 300C, and 300K.

The image forming unit 100 further includes a transfer device 140 that transfers yellow, magenta, cyan, and black toner images formed by the developing devices 110Y, 110M, 110C, and 110K to a sheet; a cleaning device (not shown) that cleans the surfaces of the photoconductive drums 102Y, 102M, 102C, and 102K; and a fixing device 116 that fixes to the sheet the toner image transferred to the sheet by the transfer device 140.

The transfer device 140 includes an intermediate transfer belt 142 to which yellow, magenta, cyan, and black toner images formed by the photoconductive drums 102Y, 102M, 102C, and 102K are transferred in a superimposed manner. It should be noted that the intermediate transfer belt 142 is rotatably supported by support rolls 146, 148, 150, and 152. The transfer device 140 further includes primary transfer rolls 156Y, 156M, 156C, and 156K that transfer the yellow, magenta, cyan, and black toner images formed by the photoconductive drums 102Y, 102M, 102C, and 102K to the intermediate transfer belt 142. The transfer device 140 further includes a secondary transfer roll 158 that transfers the yellow, magenta, cyan, and black toner images transferred to the intermediate transfer belt 142 to the sheet. Moreover, the transfer device 140 includes a cleaning device (not shown) that cleans a surface of the intermediate transfer belt 142.

The sheet feeder 200 includes a sheet holding portion 202 in which sheets are held; a delivery roll 204 that sends out sheets among the sheets placed in the sheet holding portion 202 that are located uppermost; and a separation mechanism 206 that separates the sheets sent out by the delivery roll 204. The separation mechanism 206 includes, for example, a feed roll rotatably disposed and a retard roll whose rotation is limited, and separates the sheets sent out by the delivery roll 204 from each other. Then, one separated sheet is sent out toward registration rolls 260, which is described later. The sheet holding portion 202 is configured so that it may be pulled out to the front side of the image forming apparatus 10 (to the left in FIG. 2). Pulling out the sheet holding portion 202 to the front side allows the replenishment of sheets.

The transport path 250 includes a main transport path 252, a reverse transport path 254, and an auxiliary transport path 256. The main transport path 252 is a transport path for transporting a sheet fed from the sheet feeder 200 toward the exit portion 22. Along this main transport path 252, the registration rolls 260, the secondary transfer roll 158, the fixing device 116, and exit rolls 262 are provided in that order from the upstream side toward the downstream side in the sheet transport direction. The registration rolls 260 start rotating with predetermined timing to feed a sheet to a contact portion (secondary transfer portion) between the intermediate transfer belt 142 and the secondary transfer roll 158.

The exit rolls 262 output a sheet having a toner image fixed thereon by the fixing device 116 to the exit portion 22. In the case where images are formed on both sides of a sheet, the exit rolls 262 rotate in a direction opposite to the direction of rotation for outputting a sheet to the exit portion 22, and thus feed a sheet having an image formed on one side thereof to the reverse transport path 254. The reverse transport path 254 is used in the case where a sheet having an image formed on one side thereof is fed to the upstream side of the registration rolls 260 again. The reverse transport path 254 has, for example, two pairs of reverse transfer rolls 264 provided along the reverse transport path 254.

The auxiliary transport path 256 is a transport path for use in the case where a sheet is fed through the openable sheet feed portion 26 provided on the front side of the image forming apparatus 10. This auxiliary transport path 256 has an auxiliary transport roll 266 for transporting a sheet toward the registration rolls 260, and a separation roll 268 that is in contact with the auxiliary transfer roll 266 and is used to separate sheets, which are provided along the auxiliary transport path 256.

Figure 3:
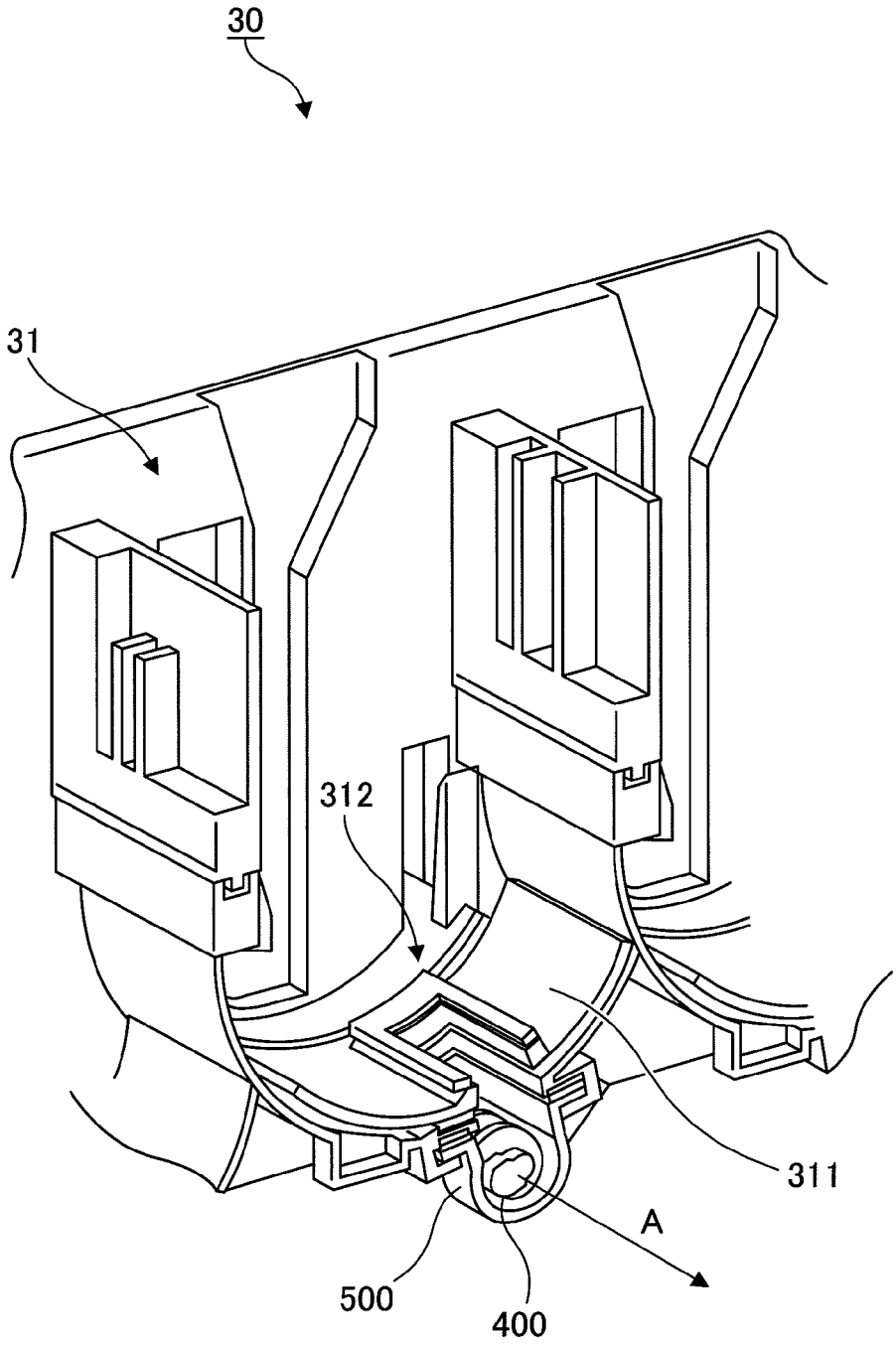
FIG. 3 illustrates an attachment portion to which the a container is attached.

FIG. 3 illustrates the attachment portion 30 (refer to FIG. 1) to which the containers 300Y, 300M, 300C, and 300K are attached.

In the attachment portion 30, four container chambers 31 are provided which house the respective containers 300Y, 300M, 300C, and 300K. It should be noted that this figure shows a container chamber 31 for housing the container 300C (refer to FIG. 1), and that another container chamber 31 is provided adjacent to the shown container chamber 31. Each container chamber 31 is formed such that an upper portion thereof is open, and has sidewalls in four directions. Further, each container chamber 31 has a bottom portion 311 and an opening 312 in the bottom portion 311. The toner discharged from each container 300 is fed downward through this opening 312.

In this exemplary embodiment, a transporting member 400 for transporting the toner fed through the opening 312 is provided below the opening 312. Further, a transport path forming member 500 is provided for holding the transporting member 400 inside thereof and forms a transport path for the toner being transported by the transporting member 400. The toner being transported by the transporting member 400 moves in the direction indicated by arrow A in the figure. Then, this toner falls downward to be fed to the developing device 110C (refer to FIG. 2, and details are described later).

Figure 4:
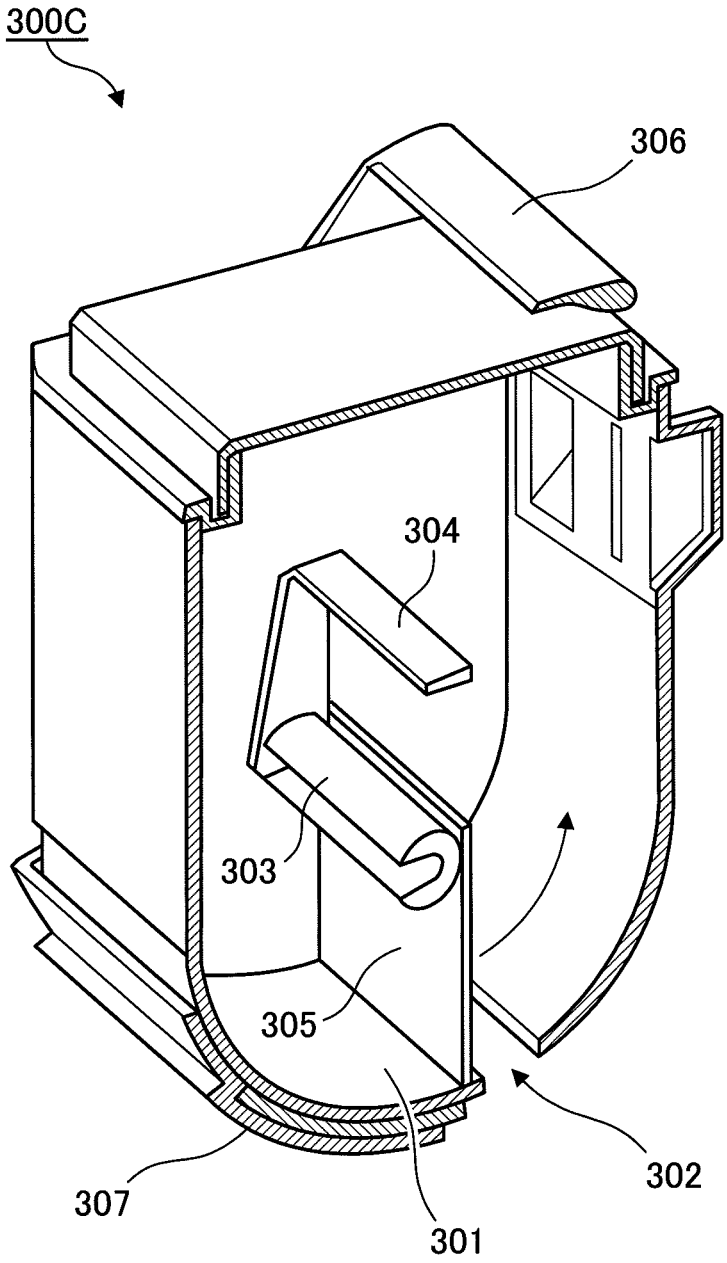
FIG. 4 illustrates the container.

FIG. 4 illustrates the containers 300Y, 300M, 300C, and 300K. It should be noted that in this figure, the container 300C is shown as an example. As shown in this figure, the container 300C, as an example of a toner containing portion, is formed in the shape of a rectangular parallelepiped. The container 300C has an exit port 302, as an example of an opening, in a bottom portion 301 thereof so as to discharge the toner contained inside thereof. This exit port 302 is disposed to face the opening 312 when the container 300C is housed in the container chamber 31. The container 300C of this exemplary embodiment discharges toner by utilizing the own weight of the toner. Specifically, the toner contained in the container 300C falls through the exit port 302 to be fed to the transporting member 400.

The container 300C also includes a rotary shaft 303 that is rotated by a driving force from an unillustrated motor, and a stirring member 304 that is attached to the rotary shaft 303 and that rotates with the rotation of the rotary shaft 303 to stir the toner contained therein. The container 300C also includes a moving member 305 provided to extend from the rotary shaft 303 toward an inner wall of the container 300C with one end thereof attached to the rotary shaft 303. The moving member 305 moves the toner contained in the container 300C to the exit port 302. The moving member 305 is formed in the shape of a plate, and has a length that allows contact with the bottom portion 301 formed to have a curvature.

The moving member 305 rotates in the direction indicated by an arrow in the figure with the rotation of the rotary shaft 303 to move the toner contained in the container 300C to the exit port 302. The toner discharged from the exit port 302 is fed to the transporting member 400 through the opening 312 (refer to FIG. 3) and then fed to the developing device 110C (refer to FIG. 2). It should be noted that the container 300C also includes a handle 306 that is operated by a user, and a lid member 307 that opens or closes the exit port 302 in response to the movement of the handle 306.

Figure 5:
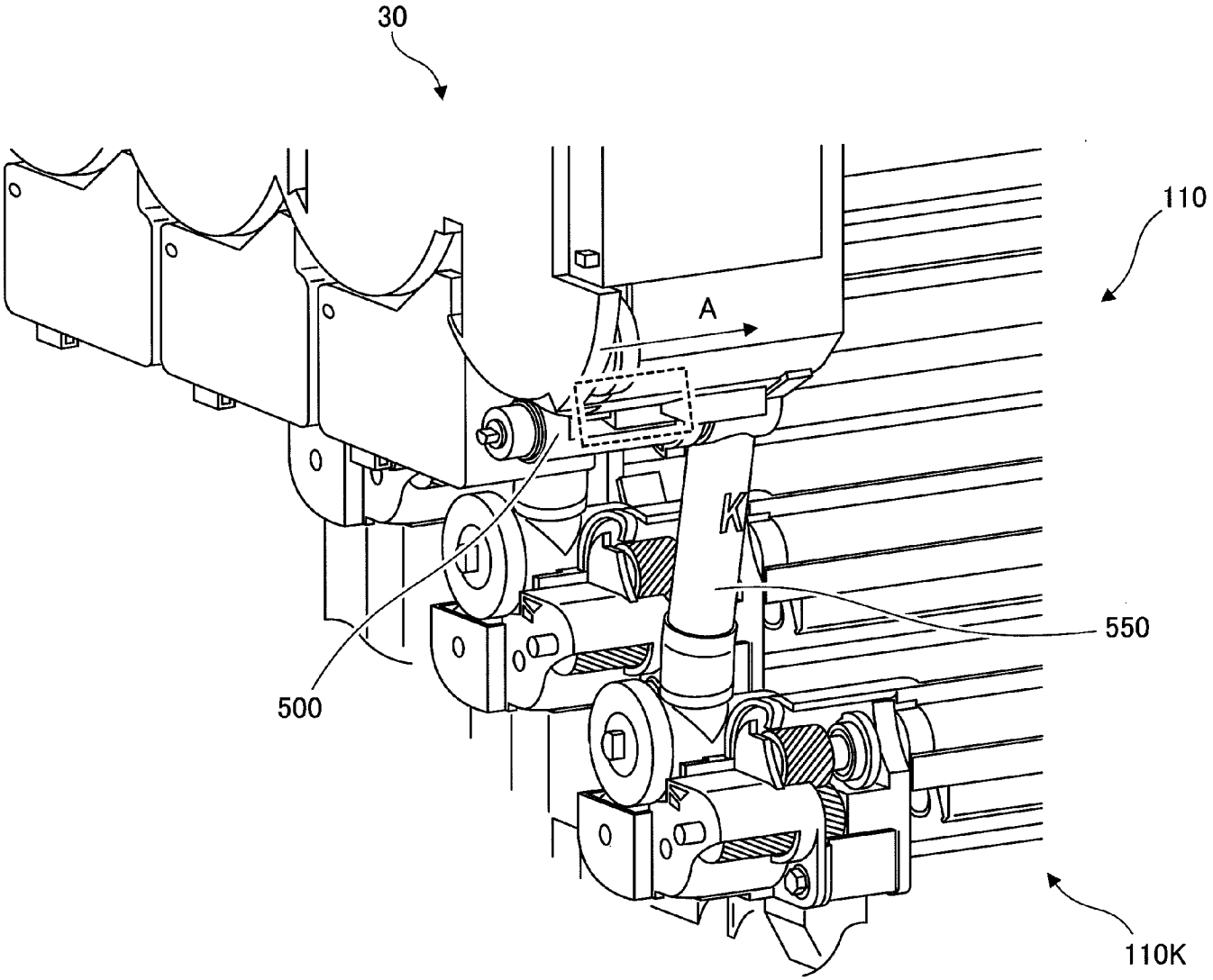
FIG. 5 illustrates the attachment portions and the developing devices as viewed from the back side of the attachment portions.

FIG. 5 illustrates the attachment portion 30 and the developing devices 110 as viewed from the back side of the attachment portion 30. Specifically, FIG. 5 illustrates the attachment portion 30 and the developing devices 110 as viewed from the direction of arrow V in FIG. 1. In this exemplary embodiment, as described above, toners are first discharged from the exit ports 302 (refer to FIG. 4) of the containers 300. After that, the toners are fed to the transporting members 400 through the openings 312 (refer to FIG. 3) of the container chambers 31 and then fed to the developing devices 110.

The transport routes of toners are further described with reference to FIG. 5. It should be noted that the transport route of the black toner is described here as an example. The above-described opening 312 is provided in a region indicated by broken lines in this figure. In other words, the opening 312 is provided on the back side of the attachment portion 30. More specifically, the opening 312 is provided on the opposite side, in the longitudinal direction of the developing device 110, of the attachment portion 30 to the side on which the developing device 110 is provided. The toner fed to the inside of the transport path forming member 500 through the opening 312 is transported in the direction indicated by arrow A in FIG. 5 (to the side on which the developing device 110 is provided) by the transporting member 400 (refer to FIG. 3). After that, this toner is fed to the inside of a cylindrical member 550 disposed to extend downward, and is fed to the developing device 110 (the developing device 110K) located thereunder.

Next, the arrangement positions of the containers 300 and the developing devices 110 are described.

Figure 6A:
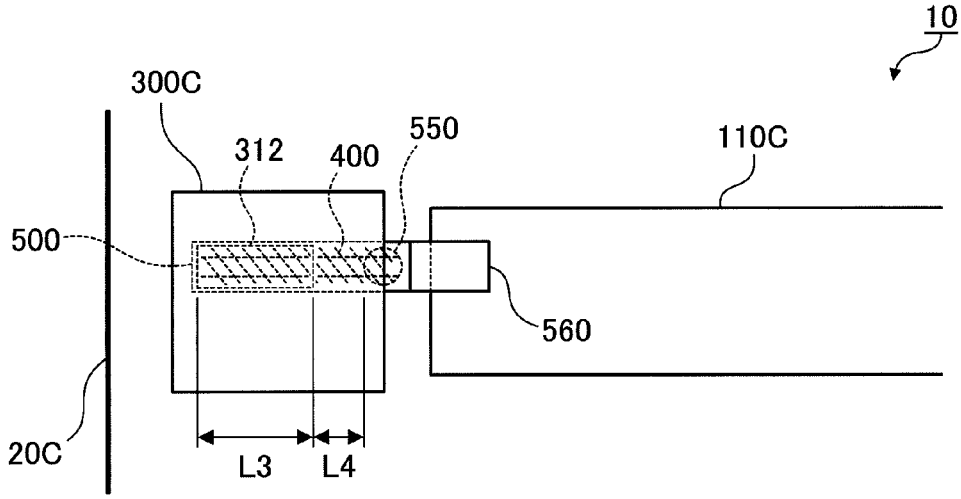
FIGS. 6A and 6B illustrate the arrangement positions of the containers and the developing devices.
Figure 6B:
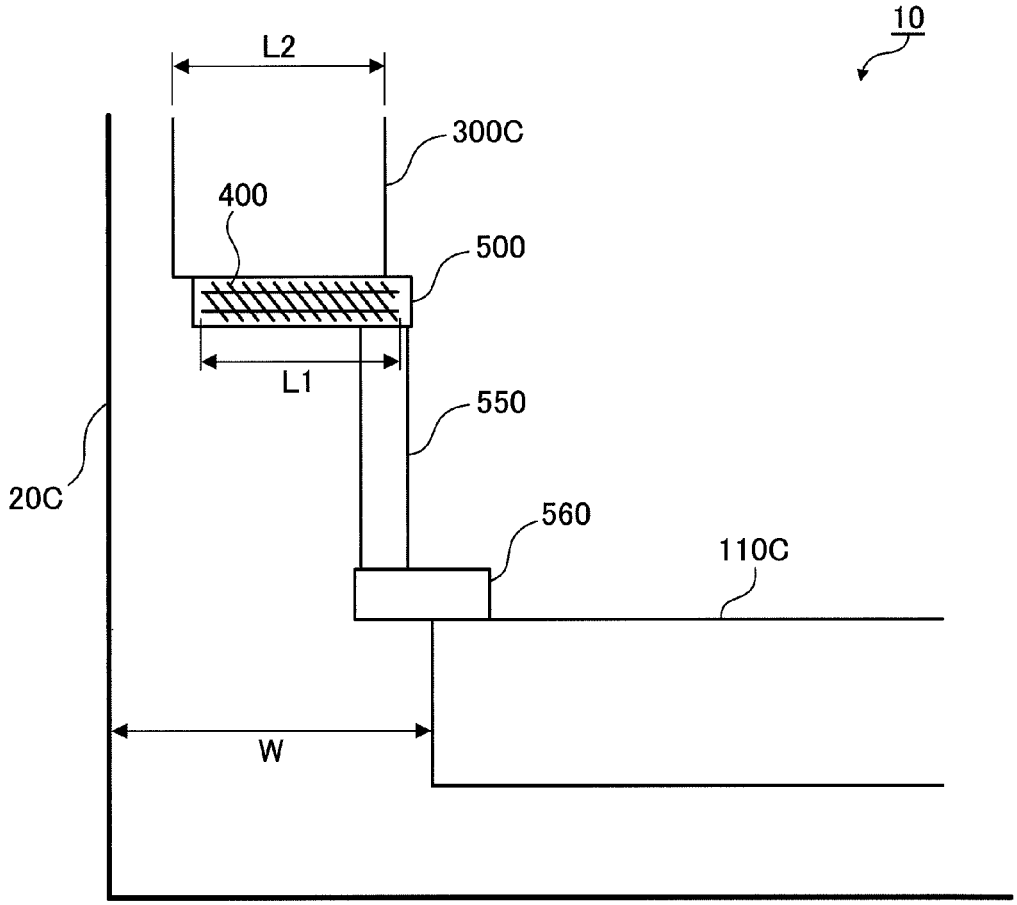

FIGS. 6A and 6B illustrate the arrangement positions of the containers 300 and the developing devices 110. It should be noted that these figures show the container 300C and the developing device 110C as examples. FIG. 6A shows a top view, and FIG. 6B shows a front view (as viewed from the front side of the image forming apparatus 10).

As shown in FIG. 6A, when the image forming apparatus 10 is viewed from above, in this exemplary embodiment, the container 300C is attached between the third sidewall 20C (also refer to FIG. 1) of the housing 20 and the developing device 110C. Further, when the image forming apparatus 10 is viewed from above, the transporting member 400 is provided between the third sidewall 20C of the housing 20 and the developing device 110C.

More specifically, as shown in FIG. 6B, the transporting member 400 is formed to have a dimension L1 smaller than a size W of a gap formed between the third sidewall 20C and the developing device 110C. A width L2 of the container 300C is also smaller than the size W of the gap. Further, the dimension L1 of the transporting member 400 is smaller than the width L2 (width of the container 300C in the direction in which the transporting member 400 is disposed) of the container 300C. Specifically, the dimension L1 of the transporting member 400 has a size that allows the transporting member 400 to be contained in the container 300C if the transporting member 400 is shifted toward the container 300C. More specifically, in FIG. 6B, the transporting member 400 protrudes from the container 300C in the direction of the width of the container 300C. However, since the dimension L1 is smaller than the width L2, if the transporting member 400 is moved to the left in the figure, the transporting member 400 does not protrude from the container 300C. It should be noted that the dimension L1 and the width L2 only needs to be smaller than the size W of the gap, and that a part of any one of the transporting member 400 and the container 300C may be disposed to overlap a part of the developing device 110C.

Further, in this exemplary embodiment, as shown in FIG. 6A, a dimension L4 is smaller than a dimension L3. The dimension L3 is the length of a part of the transporting member 400 that is located under the opening 312. Moreover, the dimension L4 is the length of a part of the transporting member 400 that is located between an inlet of a cylindrical portion 520 (refer to FIGS. 7A and 7B) and the cylindrical member 550. Specifically, the dimension L4 is the length of a part of the transporting member 400 that is located downstream of the opening 312 and located upstream of the cylindrical member 550.

In this exemplary embodiment, as described above, the length of the transporting member 400, which is denoted by L1, is set short. This makes the space in the image forming apparatus 10 occupied by the transporting member 400 small and makes the image forming apparatus 10 smaller. Setting the length of the transporting member 400 short makes toner transported to the developing device 110C prone to fluctuations in the amount thereof. Specifically, even when fluctuations have occurred in the amount of toner fed from the container 300C, the amount of toner is averaged in the course of transporting the toner if the length of the transporting member 400 is long. However, if the length of the transporting member 400 is short, the amount of toner is less likely to be thus averaged.

Accordingly, in this exemplary embodiment, the container 300C that feeds toner by causing the toner to fall is employed so that a sufficient amount of toner may be always fed to the transporting member 400. Specifically, the container 300C that feeds toner by causing the toner to fall is employed so that a sufficient amount of toner may always exist under the opening 312 (refer to FIG. 3). If the amount of toner under the opening 312 is short, the amount of toner being transported temporarily decreases, and the above-described fluctuations occur. However, if a sufficient amount of toner exists under the opening 312, the above-described fluctuations are less likely to occur.

Figure 7A:
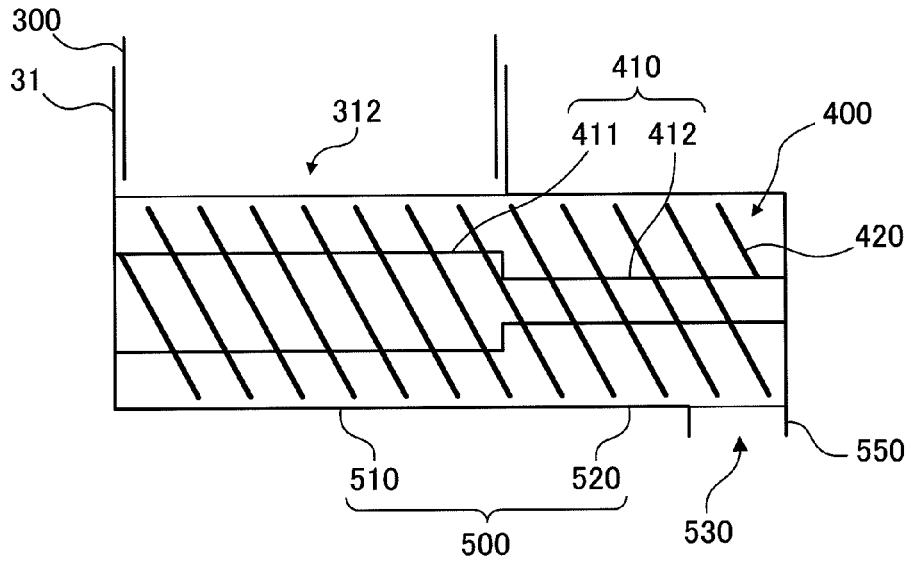
FIGS. 7A and 7B illustrate a transporting member.
Figure 7B:
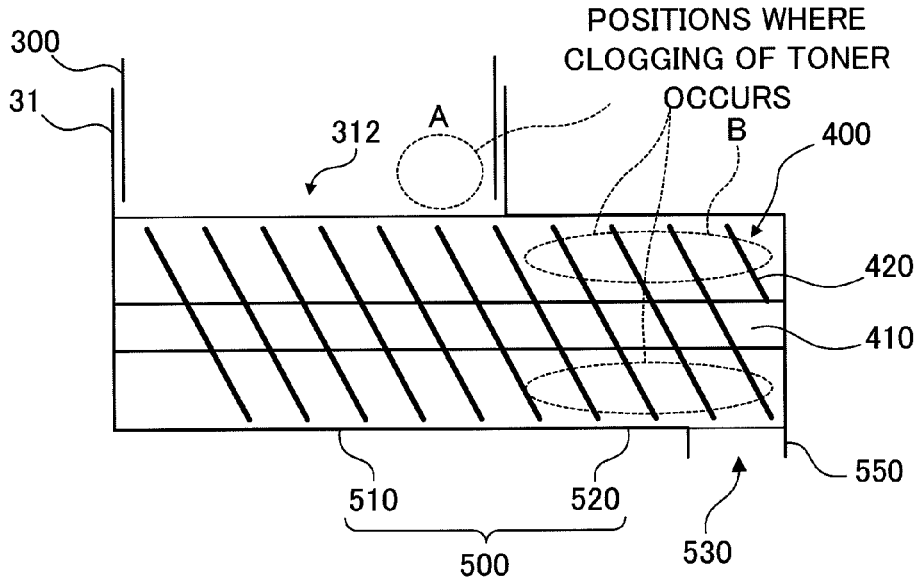

FIGS. 7A and 7B illustrate the transporting member 400.

As shown in FIG. 7A, the transporting member 400 includes a rotary shaft 410 rotated by an unillustrated motor, and a protruding portion 420 provided to protrude from the rotary shaft 410. The protruding portion 420 is provided in the form of a blade around the rotary shaft 410. Further, the protruding portion 420 is provided from one end side toward the other end side of the rotary shaft 410 and provided in a helical shape (shape of a screw). The protruding portion 420, which functions as a moving portion, presses toner with the rotation of the rotary shaft 410 to move the toner in the axial direction of the transporting member 400. The diameter of the rotary shaft 410 varies in the axial direction thereof, and the rotary shaft 410 has a large-diameter portion 411 on the upstream side in the toner transport direction, and a small-diameter portion 412 having a smaller diameter than that of the large-diameter portion 411 on the downstream side in the toner transport direction.

Here, the large-diameter portion 411 is disposed inside the transport path forming member 500, and is provided under the opening 312 (also refer to FIG. 3). On the other hand, the small-diameter portion 412 is provided inside the transport path forming member 500 and downstream of the opening 312 in the toner transport direction. Specifically, the transport path forming member 500 has an opening formation portion 510, which has an opening formed in an upper portion thereof, and a cylindrical portion 520, which is formed in the shape of a cylinder without an opening formed therein. Further, in this exemplary embodiment, the large-diameter portion 411 is provided in the opening formation portion 510, and the small-diameter portion 412 is provided in the cylindrical portion 520. In this exemplary embodiment, a cross-section of the cylindrical portion 520 is formed in a U-shape. It should be noted that a cylindrical transport path formed by the cylindrical portion 520 is not limited to a U-shape but may be in the shape of a cylinder or a prism. The opening formation portion 510 may be captured as a feed portion through which toner is fed.

It should be noted that though not described in the above description, an exit port 530 is provided in an end and lower part of the cylindrical portion 520, and toner transported by the transporting member 400 is fed to the cylindrical member 550 (also refer to FIG. 5) through the exit port 530. The cross-sectional shape of the opening formation portion 510 may be similar to that of the cylindrical portion 520, or may be a shape formed along the outer edge of the transporting member 400 (outer edge of the protruding portion 420).

In the case where the container 300 that feeds toner by causing the toner to fall is employed as described above so that a sufficient amount of toner may be fed to the transporting member 400, clogging (packing/blocking) of toner is likely to occur. For example, in the case where the transporting member 400 shown in FIG. 7B is used, toner is transported to the inlet of the cylindrical portion 520 by the transporting member 400. This inlet is also fed with toner from above. In this case, the cylindrical portion 520 does not have enough room to allow all toner to enter therein. Accordingly, an overflow of toner occurs, and clogging of toner may occur at an inlet indicated by broken line A. In other words, when the toner in the feed portion to which the toner has been fed is transported along the cylindrical transport path, the toner concentrates at the inlet of the transport path, and thereby the toner may result in clogging at the inlet. Further, in a configuration in which toner falls from above as in this exemplary embodiment, the falling toner and the toner being transported to the transporting member 400 would enter the cylindrical portion 520 in a lump. Such a configuration tends to cause a large amount of toner to be squeezed into the cylindrical portion 520. As a result, clogging of toner is also likely to occur in the cylindrical portion 520 (refer to broken lines B). Specifically, the pressure exerted on the toner in the transport path becomes higher due to increase of the toner fed to the feed portion, and thereby clogging of toner is likely to occur.

Accordingly, in this exemplary embodiment, as shown in FIG. 7A, the diameter of a part of the rotary shaft 410 that is located inside the cylindrical portion 520 is set small (refer to the small-diameter portion 412), the amount of transportation (amount of transportation per unit time) of toner inside the cylindrical portion 520 is set larger than the amount of transportation (amount of transportation per unit time) of toner in the opening formation portion 510. This makes clogging of toner less likely to occur inside the cylindrical portion 520. Moreover, a part of the rotary shaft 410 that is located under the opening 312 is set larger (refer to the large-diameter portion 411), thus reducing the amount of toner transported toward the inlet of the cylindrical portion 520 in comparison with the mode shown in FIG. 7B. This also makes clogging of toner less likely to occur at the inlet of the cylindrical portion 520. In this exemplary embodiment, the position at which the diameter of the rotary shaft 410 switches from a large diameter to a small diameter (hereinafter referred to as a "diameter change position" in some cases) coincide, in the axial direction of the transporting member 400, with the boundary (junction) between the opening formation portion 510 and the cylindrical portion 520. However, the diameter change position and the boundary may not coincide with each other in the axial direction of the transporting member 400.

Second Exemplary Embodiment

Figure 8:
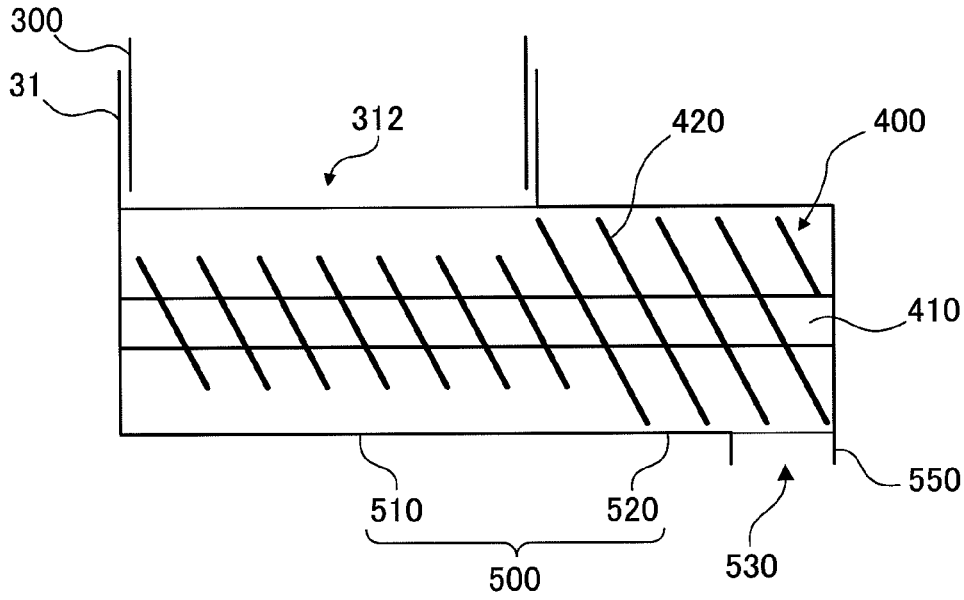
FIG. 8 illustrates a transporting member according to a second exemplary embodiment.

FIG. 8 illustrates the transporting member 400 in the second exemplary embodiment.

In the transporting member 400 in this exemplary embodiment, the diameter (outer diameter) of the protruding portion 420 varies in the axial direction of the transporting member 400 to increase the amount of transportation of toner in the cylindrical portion 520 compared to the amount of transportation of toner in the opening formation portion 510. More specifically, by making the diameter of the part of the protruding portion 420 located inside the cylindrical portion 520 larger than the diameter of the part of the protruding portion 420 located inside the opening formation portion 510, the amount of transportation (amount of transportation per unit time) of toner inside the cylindrical portion 520 is made larger than the amount of transportation (amount of transportation per unit time) of toner in the opening formation portion 510. Further, by setting the diameter of the part of the protruding portion 420 located inside the opening formation portion 510 small, the amount of transportation (amount of transportation per unit time) of toner proceeding toward the inlet of the cylindrical portion 520 is reduced compared to the amount of transportation (amount of transportation per unit time) of toner in the opening formation portion 510.

Similar to the above description, in this exemplary embodiment, clogging of toner inside the cylindrical portion 520 is less likely to occur. Also, clogging of toner which may appear at the inlet of the cylindrical portion 520 is less likely to occur. Further, since the diameter of the part of the protruding portion 420 located in the opening formation portion 510 is set small in this exemplary embodiment, a space located beneath the opening 312 is expanded, that is, a space where toner is accumulated is expanded. As a result, the amount of toner fed to the cylindrical portion 520 becomes more stable. Moreover, in the case where the diameter of the part of the protruding portion 420 located in the opening formation portion 510 is set smaller, rotational resistance of the transporting member 400 may be made small, thus making a torque required for rotating the transporting member 400 small. In other words, if the diameter of the part of the protruding portion 420 located in the opening formation portion 510, where a large amount of toner exists, is set large, the torque required for rotating the transporting member 400 has a tendency to be large. Accordingly, making the diameter of the part of the protruding portion 420 located in the opening formation portion 510 small may reduce the torque required for rotating the transporting member 400.

Third Exemplary Embodiment

Figure 9:
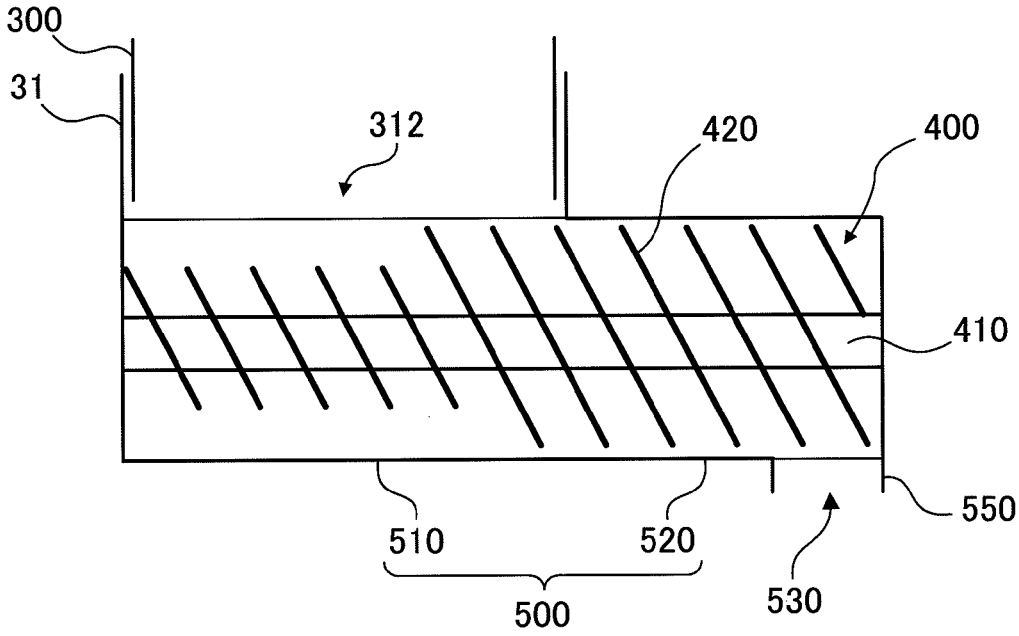
FIG. 9 illustrates the transporting member in the third exemplary embodiment.

FIG. 9 illustrates the transporting member 400 in the third exemplary embodiment.

In the transporting member 400 in this exemplary embodiment, similar to the transporting member 400 in the second exemplary embodiment, the diameter of the part of the protruding portion 420 located on the downstream side in the toner transport direction is set larger, and the diameter of the part of the protruding portion 420 located on the upstream side in the toner transport direction is set smaller. However, in this exemplary embodiment, the part of the protruding portion 420 whose diameter is set larger is not only located inside the cylindrical portion 520, but also partially located in the opening formation portion 510. In other words, the part of the protruding portion 420 whose diameter is set larger is provided to extend from an end portion (an end portion on the downstream side in the toner transport direction) of the opening formation portion 510 to the exit port 530 formed in the cylindrical portion 520. In addition, the part of the protruding portion 420 whose diameter is set larger is provided so that a part thereof is positioned beneath the opening 312. The part of the transporting member 400 located in the opening formation portion 510 is formed such that the amount of transportation of toner per unit of time is larger at the location on the downstream side in the toner transport direction than at the location on the upstream side in the toner transport direction.

In this exemplary embodiment, the toner transportation capacity is increased on the upstream side of the cylindrical portion 520 in the toner transport direction. Consequently, toner located at the inlet of the cylindrical portion 520 and above the transporting member 400 is taken into the transporting member 400 more compared to toner in other locations. As a result, clogging of toner which may occur on the upstream side of the cylindrical portion 520 (clogging of toner that occurs at the region indicated by broken line A in FIG. 7B) is more suppressed.

It should be noted that the diameter of the large-diameter part of the protruding portion 420 is not necessarily constant in the axial direction of the transporting member 400. For example, in the large-diameter part of the protruding portion 420, the diameter of the part located beneath the opening 312 may be set smaller than the diameter of the part located inside the cylindrical portion 520. Specifically, for example, the diameter of the part of the protruding portion 420 located beneath the opening 312 may be set to 9 mm and the diameter of the part of the protruding portion 420 located inside the cylindrical portion 520 may be set to 10 mm. The diameter of the small-diameter part of the protruding portion 420 may be set to, for example, 5 mm.

Fourth Exemplary Embodiment

Figure 10:
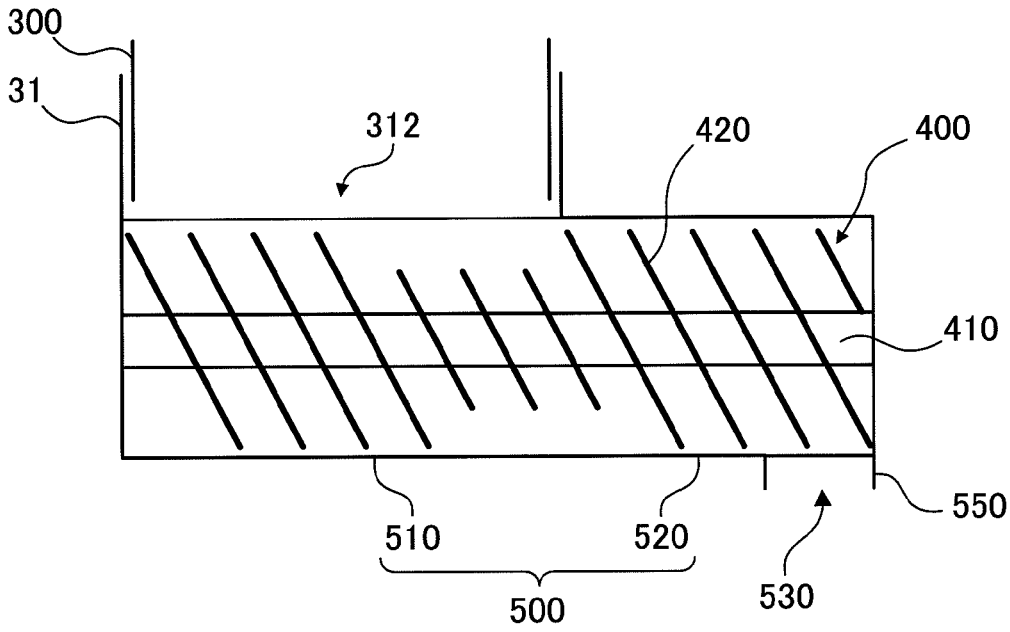
FIG. 10 illustrates the transporting member in the fourth exemplary embodiment.

FIG. 10 illustrates the transporting member 400 in the fourth exemplary embodiment.

The transporting member 400 in the exemplary embodiment is in a mode partially different in the shape from the transporting member 400 shown in FIG. 8. In the transporting member 400 shown in FIG. 8, the diameter of the part of the protruding portion 420 located in the cylindrical portion 520 is set larger than the diameter of the part of the protruding portion 420 located in the opening formation member 510. In this exemplary embodiment, in addition to setting the diameter of the part of the protruding portion 420 located in the cylindrical portion 520 large, the diameter of the part of the protruding portion 420 located in the opening formation portion 510 is also set large partially. Specifically, the diameter of the part of the protruding portion 420 located on the upstream side of the opening formation portion 510 in the toner transport direction is set large. In other words, in the transporting member 400 of this exemplary embodiment, the diameter of the part of the protruding portion 420 located on the upstream side of the cylindrical portion 520 in the toner transport direction is set smaller, and the diameter of the parts of the protruding portion in other locations is set larger. The part of the transporting member 400 located in the opening formation portion 510 is formed such that the amount of transportation of toner per unit of time is larger at the location on the upstream side in the toner transport direction than at the location on the downstream side in the toner transport direction.

In the case where the diameter of the part of the protruding portion 420 located in the opening formation portion 510 is small, the amount of transportation of toner is decreased, thereby possibly causing insufficiency in the amount of transportation of toner to the cylindrical portion 520. Therefore, in this exemplary embodiment, the diameter of the part of the protruding portion 420 located on the upstream side of the cylindrical portion 520 in the toner transport direction is set large as described above, thus increasing the amount of toner proceeding toward the cylindrical portion 520. Further, in this exemplary embodiment, the diameter of the part of the protruding portion 420 located on the upstream side of the cylindrical portion 520 in the toner transport direction is set smaller to reduce the amount of transportation of toner on the upstream side of the cylindrical portion 520. Accordingly, toner accumulation in which toner is temporarily accumulated is formed, thereby stably feeding toner to the cylindrical portion 520. Moreover, by reducing the diameter of the part of the protruding portion 420 located on the upstream side of the cylindrical portion 520 in the toner transport direction, the toner transportation speed is lowered on the upstream side of the cylindrical portion 520, and therefore clogging of toner, which may appear on the upstream side of the cylindrical portion 520, is less likely to occur.

As will be described in detail, in the case where the above-described large-diameter part of the protruding portion 420 is not provided in the opening formation portion 510, that is, all the parts of the protruding portion is of small diameter, the toner accumulation is not formed on the upstream side of the cylindrical portion 520 in some cases. If the amount of toner fed through the opening 312 is temporarily decreased with this situation, the amount of toner fed to the inside of the cylindrical portion 520 is decreased, and thereby variations arise in the density of toner fed to the developing device 110. In the configuration of this exemplary embodiment, formation of the toner accumulation may bring stable toner transportation and suppresses clogging of toner as described above. In this exemplary embodiment, the diameter of the protruding portion 420 is partially reduced to lower the amount of transportation of toner on the upstream side of the cylindrical portion 520 in the toner transport direction. However, the amount of transportation of toner may also be reduced by increasing the diameter of the rotary shaft 410 on the upstream side of the cylindrical portion 520. It should be noted that, if the length of the cylindrical portion 520 in the longitudinal direction is considerably extended, fluctuation in the amount of toner transported inside the cylindrical portion 520 may be suppressed, and thereby variations in toner density in the developing device 110 may also be suppressed.

In the above-described first to fourth exemplary embodiments, the case where the transporting member 400 is provided to the main body of the image forming apparatus 10 is described as an example. However, the transporting member 400 may be provided to the container 300.

Figure 11A:
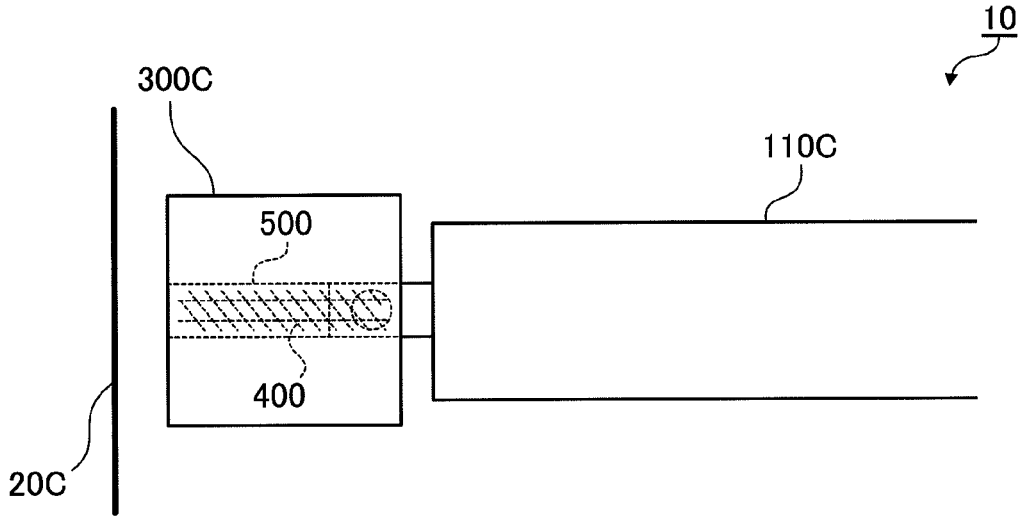
FIGS. 11A and 11B illustrate a configuration example in which the transporting member is provided in the container.
Figure 11B:
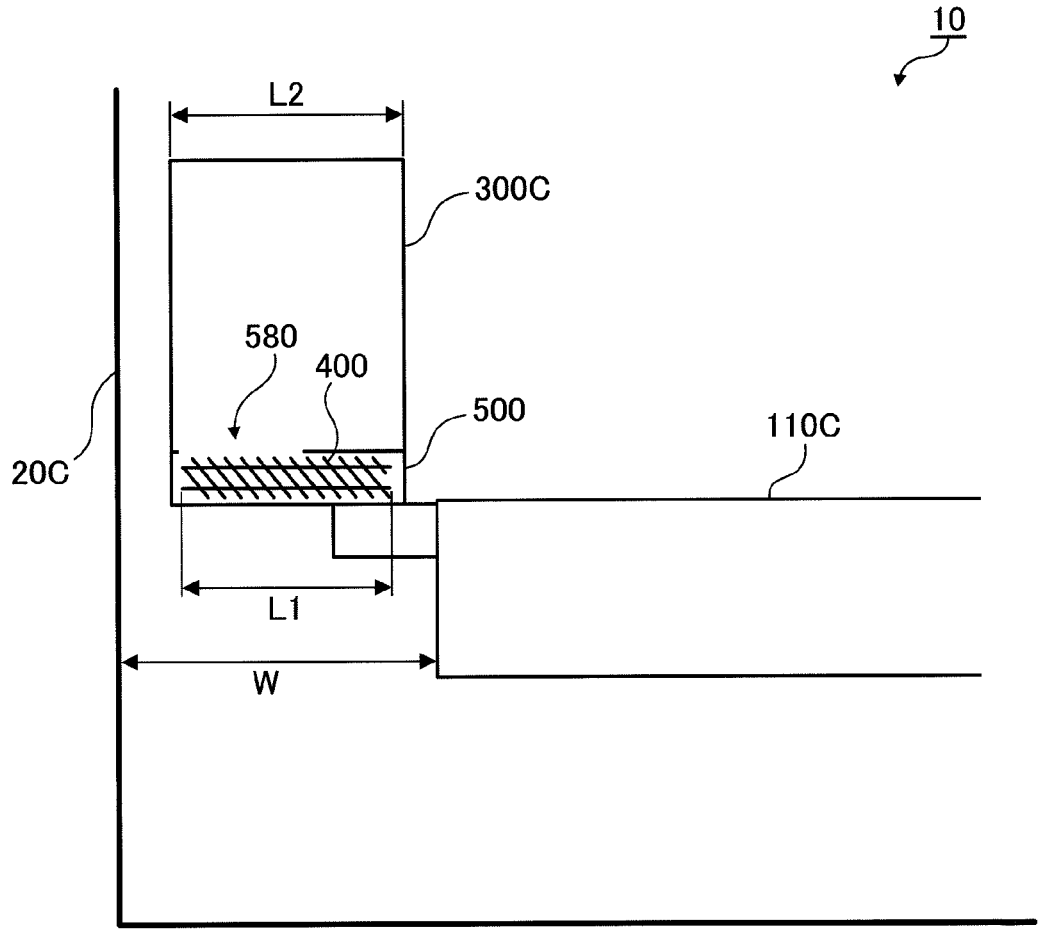

FIGS. 11A and 11B illustrate a configuration example in which the transporting member 400 is provided in the container 300. Here, FIG. 11A shows a top view and FIG. 11B shows a front view (as viewed from the front side). Further, these figures show the container 300C and the developing device 110C as examples.

In the image forming apparatus 10 in these figures, the transport path forming member 500 that has an opening 580 in an upper portion and that is formed in the shape of a cylinder is attached to a lower part of the container 300C (refer to FIG. 11B). The transporting member 400 is housed in the transport path forming member 500. Toner (cyan toner) contained in the container 300C falls downward through the opening 580 formed in the transport path forming member 500 to be fed to the transporting member 400. The toner fed to the transporting member 400 is transported to the developing device 110C. It should be noted that in the configuration example shown in these figures, the cylindrical member 550 (refer to FIG. 5) is not provided.

In the configuration example shown in these figures, as shown in FIG. 11B, the transporting member 400 is also formed to have a dimension L1 smaller than a size W of the gap formed between the third sidewall 20C and the developing device 110C. Further, a width L2 of the container 300C is also smaller than the size W of the gap. Moreover, the dimension L1 of the transporting member 400 is smaller than the width L2 of the container 300C (width of the container 300C in the direction in which the transporting member 400 is disposed). Furthermore, in the configuration example shown in these figures, as shown in FIG. 11B, the transporting member 400 does not protrude from the container 300C, and the transporting member 400 is inside the width of the container 300C.

It should be noted that though in the above-described first to fourth exemplary embodiments, a description is made of an example in which the transporting member 400 is provided in a transport route for transporting toner to the developing devices 110, the transporting member 400 may, of course, be provided in, for example, a transport route for transporting waste toner produced in the cleaning of the photoconductive drums 102Y, 102M, 102C, and 102K. Further, though in the above-described first to fourth exemplary embodiments, the case where the transporting member 400 is provided in a lower part of the container 300 is exemplified, the attachment position of the transporting member 400 is not limited to a lower part of the container 300. For example, in the mode shown in FIGS. 6A and 6B, toner transported through the cylindrical member 550 is transported to the developing device 110C using a second cylindrical member 560. The transporting member 400 may be provided in the second cylindrical member 560.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner cartridge storing a toner therein:

a developing device developing a latent image; and a transport path having a transporting member that is extended along the transport path, and having an inlet through which the toner is supplied from the toner cartridge disposed at an upstream side of the transport path, the transport path transports the toner to the developing device, wherein the transporting member includes a rotary shaft and a blade disposed around the rotary shaft, and a diameter of the rotary shaft at a downstream side of a transporting direction is smaller than a diameter of a rotary shaft at the upstream side of the transporting direction.

2. An image forming apparatus comprising:

a toner cartridge storing a toner therein;

a developing device developing a latent image; and a transport path having a transporting member that is extended along the transport path, and having an inlet through which the toner is supplied from the toner cartridge disposed at an upstream side of the transport path, the transport path transports the toner to the developing device, wherein the transporting member includes a rotary shaft blade disposed around a rotary shaft, and a diameter of the rotary shaft changes such that the amount of transportation of toner per unit of time is larger at a part located in a downstream side in a toner transport direction than at a part located in an upstream side in the toner transport direction.

3. The image forming apparatus according to claim 1, further comprising:

a toner containing portion that contains toner and feeds the toner to the feed portion, wherein the toner containing portion has an opening on a bottom portion thereof, and causes the toner contained therein to fall down from the opening, thus feeding the toner to the feed portion.

4. A toner container comprising:

a containing portion that contains toner;

a feed portion that is fed from above with the toner from the containing portion;

a transport path that includes an inlet through which the toner fed to the feed portion enters, that allows the toner to be transported therethrough, and that is in a cylindrical shape; and a transporting member provided to continuously extend from the feed portion to the transport path, the transporting member transporting along the transport path the toner fed to the feed portion, wherein an amount of transportation of the toner per unit of time at a part of the transporting member located in the transport path is larger than an amount of transportation of the toner per unit of time at a part of the transporting member located in the feed portion, wherein:

the transporting member includes a rotary shaft provided to extend from the feed portion to the transport path and a moving portion disposed around the rotary shaft in a helical shape and presses toner with the rotation of the rotary shaft to move the toner, and a diameter of a part of the rotary shaft located in the transport path is set smaller than a diameter of a part of the rotary shaft located in the feed portion to make the amount of transportation of the toner per unit of time at the part of the transporting member located in the transport path larger than the amount of transportation of the toner per unit of time at the part of the transporting member located in the feed portion.

5. The toner container according to claim 4, wherein the toner containing portion has an opening on a bottom portion thereof, and causes the toner contained therein to fall down from the opening, thus feeding the toner to the feed portion.

6. The image forming apparatus according to claim 1, wherein the diameter of the rotary shaft at the upstream side extends across an inlet through which the toner is supplied from the toner cartridge.

7. The image forming apparatus according to claim 6, wherein the diameter is constant in the upstream side and the downstream side, and the diameter changes from a larger diameter to a smaller at an edge of the inlet.

* * * * *